US008783989B2

(12) United States Patent
Weigel et al.

(10) Patent No.: US 8,783,989 B2
(45) Date of Patent: Jul. 22, 2014

(54) COSMETIC APPLICATOR, IN PARTICULAR MASCARA APPLICATOR, AND A COSMETIC PRODUCT

(75) Inventors: Friedrich Weigel, Wittelshofen (DE); Werner Fischer, Burk (DE)

(73) Assignee: GEKA GmbH, Bechhofen (DE)

( * ) Notice: Subject to any disclaimer, the term of this patent is extended or adjusted under 35 U.S.C. 154(b) by 710 days.

(21) Appl. No.: 12/959,259

(22) Filed: Dec. 2, 2010

(65) Prior Publication Data

US 2011/0135376 A1 Jun. 9, 2011

(51) Int. Cl.
*A46B 11/00* (2006.01)

(52) U.S. Cl.
USPC ..... 401/127; 401/126; 132/218

(58) Field of Classification Search
USPC ..... 401/126–130; 15/172, 201–203, 106; 132/218, 320
See application file for complete search history.

(56) References Cited

U.S. PATENT DOCUMENTS

| | | | | |
|---|---|---|---|---|
| 4,165,755 | A | 8/1979 | Cassai | |
| 4,428,388 | A * | 1/1984 | Cassai et al. | 132/218 |
| 5,137,038 | A * | 8/1992 | Kingsford | 132/218 |
| 5,620,270 | A * | 4/1997 | Gueret | 401/126 |
| 6,029,675 | A | 2/2000 | Dumler | |
| 7,469,702 | B2 * | 12/2008 | Kim | 132/218 |
| 7,473,046 | B2 * | 1/2009 | Kraus et al. | 401/117 |
| 8,087,415 | B2 * | 1/2012 | Pires et al. | 132/218 |
| 2007/0000513 | A1 | 1/2007 | Gueret | |

FOREIGN PATENT DOCUMENTS

| | | | |
|---|---|---|---|
| EP | 0162722 | A2 | 11/1985 |
| EP | 817579 | B1 | 5/2003 |
| EP | 1369056 | A1 | 12/2003 |
| FR | 2678494 | A1 | 1/1993 |
| JP | 2009082554 | | 4/2009 |
| WO | 2004077987 | A1 | 9/2004 |

* cited by examiner

*Primary Examiner* — David Walczak
(74) *Attorney, Agent, or Firm* — Setter Roche LLP

(57) ABSTRACT

A cosmetic applicator, in particular a mascara applicator, having a first applicator region and at least one additional applicator region in which the applicator regions are connected to each other in movable fashion relative to each other by means of an articulation and/or the additional applicator region is connected to the first applicator region in a way that allows it to be slid in linear fashion relative to the first applicator region. A cosmetic product may also include the applicator.

7 Claims, 5 Drawing Sheets

A
A
16
11
8
5
29
3

29'
100

11
4a
31
30
8
10
5
29
A-A
3
100
10
8
5
29
32
3

10'
5
8
3

COSMETIC APPLICATOR, IN PARTICULAR MASCARA APPLICATOR, AND A COSMETIC PRODUCT

FIELD OF THE INVENTION

The invention relates to a cosmetic applicator and a cosmetic product having the cosmetic applicator.

BACKGROUND OF THE INVENTION

A cosmetic applicator device of this generic type is known from EP 0 817 579 B1. The cosmetic applicator disclosed therein has a first applicator region, for example composed of beads threaded onto a wire, and a second applicator region, which can be embodied for example in the form of a comb applicator. In this instance, it is disadvantageous that the comb applicator at the distal end gets in the way when using the beaded applicator to apply mascara compound since particularly when applying mascara compound in an eyelash region directly adjacent to the user's nose, the comb applicator can touch the skin in the region of the base of the user's nose and leave undesirable marks.

US 2007/0000513 A1 has disclosed an applicator for cosmetics, which has an applicator region at the end of an applicator rod and the applicator rod is embodied as elastically flexible by means of at least one constriction along the length of the rod. The constrictions or deformation regions of the applicator rod are designed so that when the applicator is not in use, the applicator rod automatically springs elastically back to the position in which it is oriented in a straight line.

EP 1 369 056 A1 has disclosed a cosmetic applicator in which an applicator region is situated at one end of an applicator rod and the other end of the applicator rod is supported in articulating fashion in a grip piece.

The object of the invention is to modify a generic cosmetic applicator so that a user is able to use the cosmetic applicator in an unlimited way and in particular, cosmetic, particularly mascara compound, is prevented from being inadvertently applied to the skin regions in the vicinity of the person's eye.

The invention should also increase the variability and variety of possible uses of the applicator. Another object of the invention that, preferably, is likewise to be attained is to disclose an applicator that makes it possible to wet the applicator regions with different amounts of mascara cosmetic; in particular, it should be possible to completely or almost completely prevent one of the applicator regions from being wetted with mascara fluid. It should be possible to use such an applicator region, which is not wetted or hardly wetted, as an applicator region for finely distributing mascara fluid to the eyelashes.

SUMMARY OF THE INVENTION

A cosmetic applicator according to the invention having a first applicator region and at least one additional applicator region is characterized in that the applicator regions are connected to each other and are movable relative to each other by means of an articulation and/or the additional applicator region is connected to the first applicator region in a way that allows it to be slid in linear fashion relative to the first applicator region. Such an applicator has the advantage that when the first applicator region is being used, the additional applicator region can be moved out of a region in which there is a risk of the additional applicator region colliding with portions of the user's skin that should not be wetted. On the one hand, this can be accomplished by pivoting it out of the way. To accomplish this, the additional applicator region is connected to the first applicator region in an articulating fashion. On the other hand, this can alternatively or additionally be accomplished by means of a linear sliding of the additional applicator region relative to the first applicator region. To accomplish this, the additional (outer) applicator region can be pulled closer to the end of the first applicator region, thus reducing the risk of a collision. In a particular embodiment, the additional applicator region can be retracted into a cavity in the first applicator region and thus completely removed from the risky region. In another particular embodiment, the additional applicator region can be folded into the first applicator region in the same way that the blade of a pocket knife is folded into the pocket knife handle as it is closed.

The articulation is suitably embodied in the form of a hinge joint having a hinge axle; the at least one additional applicator region is preferably able to pivot in a plane that is either situated parallel to a longitudinal axis of the cosmetic applicator or contains this longitudinal axis. Such a hinge joint is typically characterized in that it has two hinge elements that move in gliding fashion relative to each other.

In another suitable embodiment, the articulation between the first applicator region and the additional applicator region is embodied in the form of a ball-and-socket joint with a joint socket and a joint head. In this embodiment, it is particularly advantageous that the swiveling range of the additional applicator region relative to the first applicator region is not limited to a plane, but can instead be moved anywhere in the space within a swivel cone.

The first applicator region is advantageously situated distally farther toward the inside relative to the additional applicator region, i.e. closer to the grip piece of the applicator, whereas the additional applicator region is situated distally farther toward the outside, at the distal end of the first applicator region, particularly when in an operating position in which the additional applicator region is used.

According to another advantageous embodiment, the distally outer applicator region can be retracted into and extended from a cavity in the distally inner applicator region by means of a suitable mechanism so that the distally outer applicator region can be completely removed from a risky region.

In another possible embodiment of the applicator according to the invention, it is possible to embody the first and second applicator regions so that in a position in which the additional applicator region is folded in, they can be placed so that they rest against each other along a longitudinal plane of the first applicator region, in particular along a longitudinal central plane of the first applicator region. In this embodiment, the first applicator region and the additional applicator region are thus conceptually formed by means of a longitudinal dividing plane, in particular a longitudinal, central dividing plane of the cosmetic applicator.

It has turned out to be particularly preferable to permit the distally outer applicator region to swivel relative to the first applicator region, within a swivel cone with a cone angle of $0<\alpha\leq 90°$, in particular $0<\alpha\leq 45°$. This provides a sufficient ability for the applicator region, which is in the way in certain application situations, to be removed from the risky region.

In an advantageous modification, the additional applicator region is situated so that it is able to rotate relative to the first applicator region, around the longitudinal axis of the first applicator region. By means of this, when a hinge joint is provided, it is likewise possible, through the additional degree of freedom of movement that this affords, to implement a mobility of the additional applicator region within a swivel cone.

Preferably, the connection between the first applicator region and the at least one additional applicator region is embodied as detachable. This makes it easily possible to embody the additional applicator region as replaceable. Consequently, various applicator types functioning as the additional applicator region can be associated with a first applicator and it is also possible, if need be, to inexpensively and easily replace worn applicators.

In order to increase the variability of the possible uses of the cosmetic applicator according to the invention, it is advisable to embody the first applicator region and the at least one additional applicator region as different applicator types with regard to their application behaviors. For example, it can be useful to embody the first applicator region in the form of a grooved applicator and the additional applicator region in the form of a brush applicator. Naturally, it is also conceivable for them to be embodied in the form of disc applicators and other known applicator types, depending on the intended use.

If the applicator regions are both embodied in the form of brush-type applicators, then the applicator regions can advantageously differ with regard to the density, stiffness, and shape of the bristles, i.e. with regard to the bristle properties in general, and can thus assure an increased variability of use.

In the case of grooved applicators, it is likewise advisable to select different widths, depths or conicities, and/or cross-sectional geometries of the grooves.

It is also advantageous to embody for example one, preferably the first, applicator region as rigid relative to its longitudinal axis and to embody the other applicator region as elastically flexible relative to its longitudinal axis. This makes it possible to finely tune the cosmetic applicator to adapt it to the user's eyelashes and eye shape.

So that the cosmetic applicator can be maneuvered in a convenient, ergonomically favorable way, it is advisable to provide a manipulating device by means of which the at least two applicator regions can be moved relatively to each other without requiring the user to touch the applicator regions—which have been wetted for use—with her fingers. To accomplish this, it is possible, for example, to provide an actuating pin or actuating sleeve. It can likewise be advantageous for an opening of a storage container for mascara fluid to be geometrically adapted to the additional applicator region so that the latter can be pivoted relative to the first applicator region by tilting the cosmetic applicator inside the opening.

A linear sliding of the additional applicator region relative to the first applicator region can take place, for example, by means of a rotary mechanism that converts a rotary motion at the applicator grip into a linear motion of the additional applicator region relative to the first applicator region. Preferably, a thread is used for this purpose, in the best instance being embodied in the form of a "threaded rod/nut" combination. It is alternatively also conceivable to provide a "toothed rack/pinion" combination.

According to a particularly preferred embodiment, the articulations are embodied in the form of so-called clamped articulations in other words, in terms of their fit relative to each other, the articulations are embodied so that during operation, or more precisely stated, when being used in the usual way, i.e. when being used as intended during application of mascara cosmetic, once the applicator regions are set in a position relative to each other, they maintain this position. To this end, the breakaway moment of the selected articulation design must be selected so as to prevent an unintentionally easy swiveling of the applicator regions relative to each other. For example, this is successfully achieved by means of an appropriately narrow-toleranced matching of the articulation axis to the joint yokes or joint eye of the corresponding applicators. A high breakaway moment can also be achieved through appropriate selection of the fit of the joint head relative to the joint socket. The purpose of this is to modify an applicator according to the invention so that once the position of the applicator regions relative to each other has been set, they do not inadvertently swivel relative to each other, returning to a starting position—at least they do not do so automatically.

The invention also relates to a cosmetic product, in particular a mascara cosmetic product, having a cosmetic applicator according to the invention.

The invention will be explained in greater detail below by way of example in conjunction with the drawings.

DETAILED DESCRIPTION OF THE PREFERRED EMBODIMENTS

Figure 1:
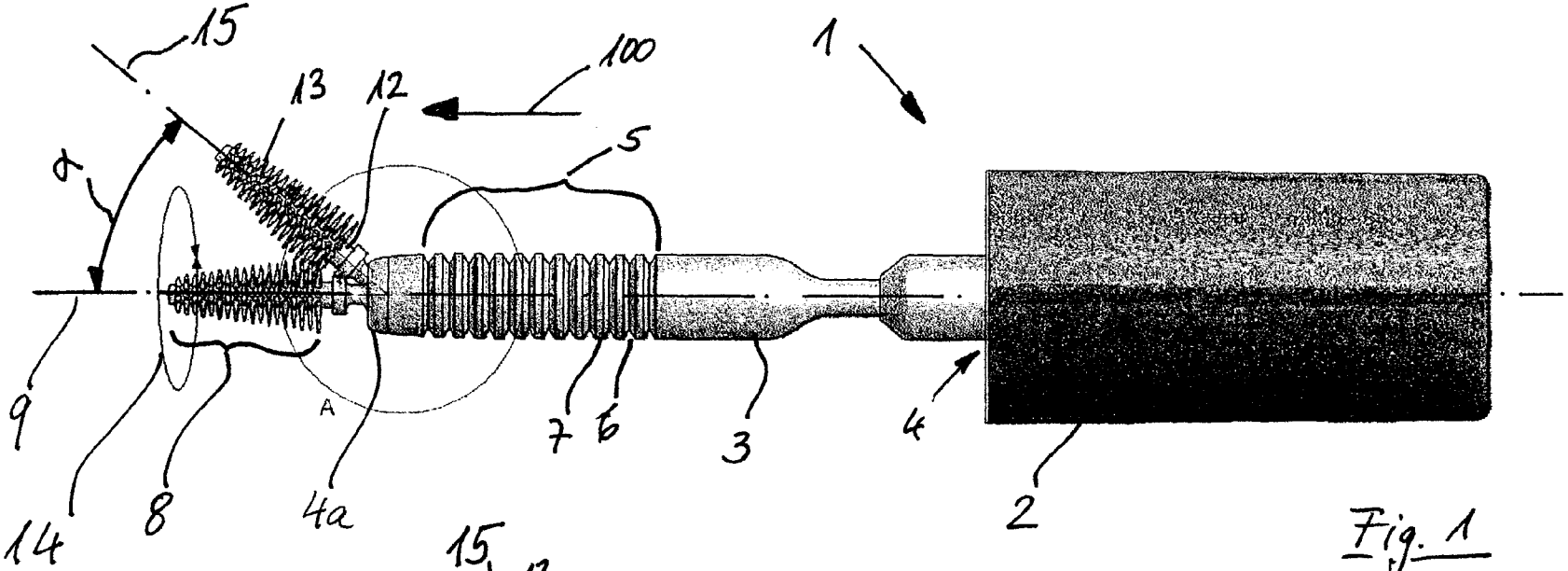
FIG. 1 shows a first embodiment of a cosmetic applicator according to the invention.

A cosmetic applicator 1 according to the invention is embodied in the form of a mascara applicator and has a grip 2. An applicator rod 3 extends away from the grip 2 in a longitudinal direction 100. The applicator rod 3 has a grip end 4 and a distal end 4*a*. A subregion of the longitudinal span of the applicator rod 3 is embodied in the form of a first applicator region 5. In the embodiment according to FIG. 1, the first applicator region 5 is embodied in the form of a so-called grooved applicator with a multitude of grooves 6 situated next to one another, i.e. preferably grooves 4 through 16. The grooves 6 constitute recesses that are separated from one another by fins 7. In this case, the grooves and fins are preferably embodied so that they exert a combing and/or separating action on the eyelashes that come into contact with them.

After the distal end 4*a* in the longitudinal direction 100, an additional applicator region 8 embodied in the form of a brush applicator, is provided. The additional applicator region 8 in FIG. 1 is shown on the one hand in a position coinciding with the longitudinal axis 9 of the cosmetic applicator and on the other, in a position that is inclined at an angle α. For the sake of clarity, it should be noted that FIG. 1 is not a depiction of an applicator 1 with two brush attachments, but instead depicts one and the same brush attachment, firstly in a position coinciding with the longitudinal axis and secondly in a position that is inclined in relation to it.

At its end oriented toward the distal end 4*a*, the additional applicator region 8 according to FIG. 1 is equipped with a joint ball 10, which is accommodated in a joint socket 11. The joint socket 11 is formed into the end surface of the applicator rod 3 at the distal end 4*a*. An applicator support 12 from which bristles 13 extend radially outward extends away from the joint ball 10.

Figure 1A:
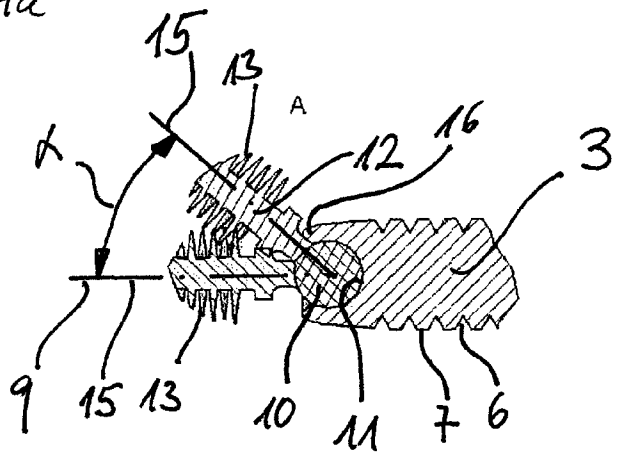
FIG. 1*a* is an enlarged sectional depiction of the detail A from FIG. 1.

The joint ball 10 and the joint socket 11 form an articulating connection between the first applicator region 5 and the second applicator region 8; in the embodiment according to FIGS. 1 and 1*a*, the joint socket 11 is embodied as symmetrical to the longitudinal axis 9 of the applicator rod 3, while an opening of the joint socket 11 is situated in the end surface of the applicator rod 3.

The articulation 10, 11 is preferably embodied in the form of a clamped articulation. This means that the joint ball 10 and the joint socket 11 are matched with regard to the tolerances and with regard to the elastic properties of the materials used for the joint ball 10 and joint socket 11 so that a breakaway moment is required in order to change the positions of the two applicator regions 5 and 8 relative to each other.

The power of the breakaway moment is advantageously calibrated so that the position of the two applicator regions 5 and 8 is fixed when subjected to forces customarily occurring during use of the cosmetic applicator. Only when a minimum swiveling moment is exceeded can the brush applicator 8 be swiveled relative to the first applicator region 5 or rotated around the longitudinal axis 15. This assures that the applicator regions 5 and 8 are fixed in relation to each other when used as intended, but permits their position relative to each other to nevertheless be changed by a user, solely by hand or for example by using a manipulator pin that is provided with/on the mascara applicator, for example the stylus that is provided for a palm-top computer and is used to make entries via the touchscreen. Alternatively, the inside of the cap can be used as a holder for manipulating the swiveling applicator region.

The additional applicator region 8 (brush applicator) is supported so that in each angled position or in the non-angled position, it is able to rotate around its longitudinal axis in the applicator rod 3.

A maximum swiveling range of the additional applicator 8 relative to the first applicator region 5 is depicted in FIGS. 1 and 1*a*. The maximum swiveling range is established by a boundary edge 16 of the joint socket 11, which cooperates with the applicator support 12.

Consequently, the brush applicator is able to move within a swivel cone, which is defined by the longitudinal axis 9 of the cosmetic applicator and the longitudinal axis 15 of the additional applicator region 8 when it is pivoted out to its maximum position. In an embodiment according to FIGS. 1 and 1*a* that is equipped with a ball joint, ranges of 0° to 60°, and in particular 0 to 45° are particularly preferable for the cone angle α, which is defined by the longitudinal axis of the cone and a surface line of the circumference surface of the cone (in this case, the longitudinal axis of the additional applicator region 8 in the maximally pivoted position). When the articulation 10, 11 is embodied in the form of a hinge joint, which is described further below, an angular range of 0° to 90° or even greater is conceivable for the angle α.

Figure 2:
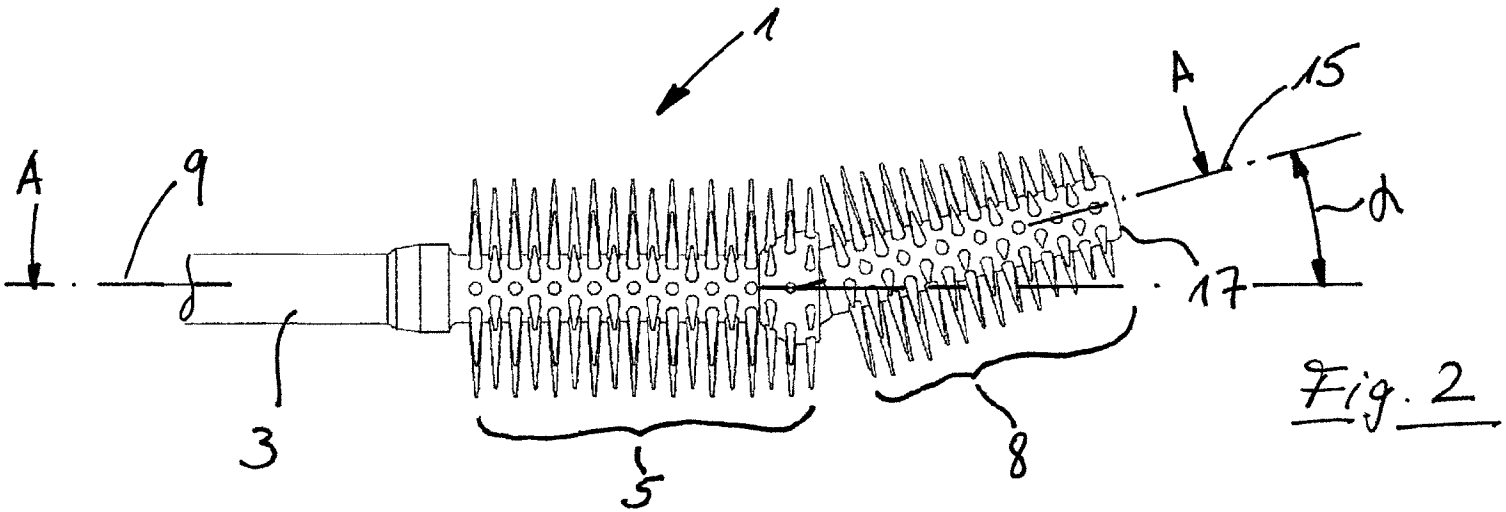
FIG. 2 shows a second embodiment of a cosmetic applicator according to the invention.
Figure 2A:
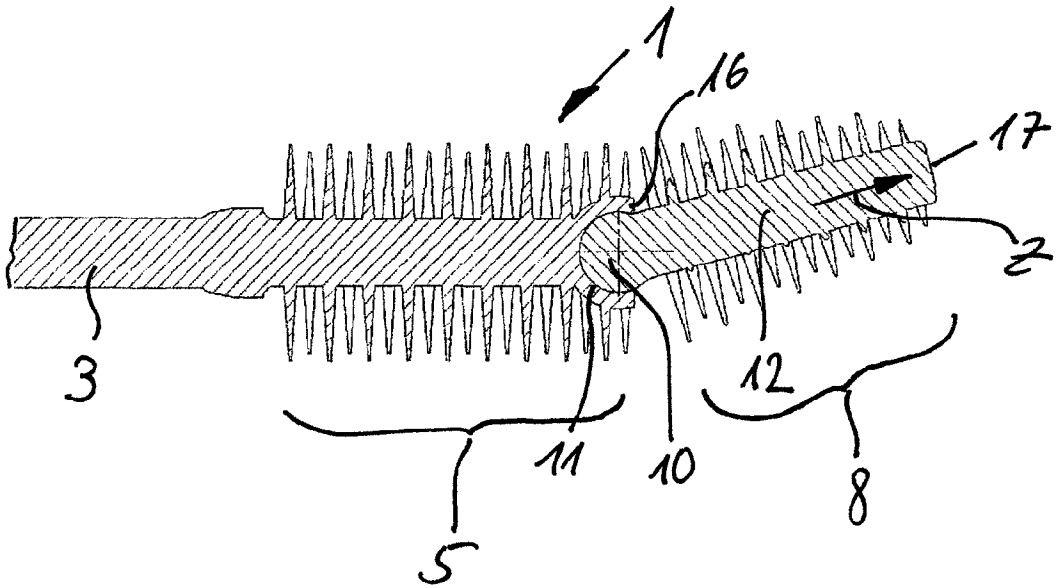
FIG. 2*a* shows a longitudinal section through the cosmetic applicator according to FIG. 2, along the cutting plane A-A.

FIGS. 2 and 2*a* show another embodiment of the cosmetic applicator 1. In this embodiment, the first applicator range 5 is embodied in the form of a bristle applicator/brush applicator in which the bristles are essentially the same length over the longitudinal span of the bristle applicator, yielding an essentially cylindrical bristle applicator.

The second applicator region 8 is likewise embodied in the form of a bristle applicator in which the bristles become continuously shorter toward the free end 17. This yields a conical bristle applicator. In this embodiment and in the embodiment according to FIGS. 1 and 1*a*, the joint ball 10 is advantageously snapped into the joint socket; the joint socket is at least elastically deformable so that the joint ball 10 can be popped out of the joint socket 11 by exerting a tensile force Z on the second applicator region 8 or by moving it past the stop in order to pry it out. In this way, an applicator 8 of a different type can be easily inserted into the joint socket 11, for example so as to provide a first applicator region 5 in the form of a bristle applicator and a second applicator region 8 in the form of a grooved applicator. An embodiment of this kind is generally advisable for all applicators according to the invention with a ball-like or socket-like articulation.

Figure 3:
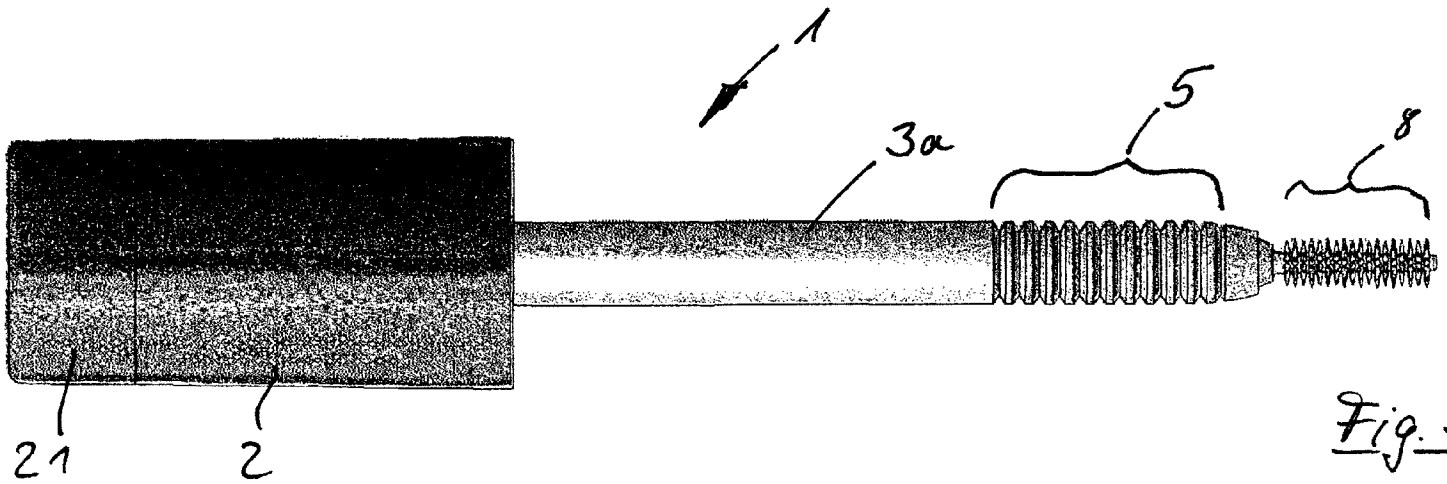
FIG. 3 shows another embodiment of the cosmetic applicator according to the invention.
Figure 3A:
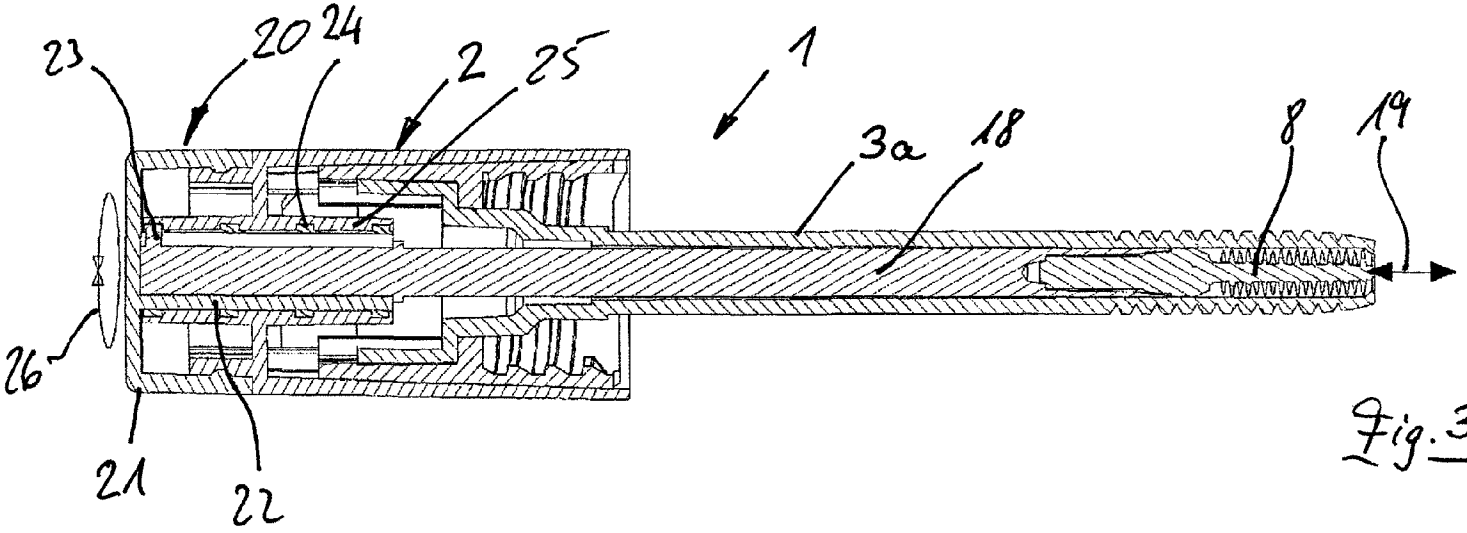
FIG. 3*a* shows a longitudinal section through the cosmetic applicator according to FIG. 3.

FIGS. 3 and 3*a* show another embodiment of the cosmetic applicator 1 according to the invention. In this embodiment, the applicator rod 3 is hollow, e.g. embodied in the form of an applicator tube 3*a*. As described above, the applicator rod 3 has a first applicator region 5 that is embodied in the form of a grooved applicator. Inside the applicator tube 3*a*, a push rod 18 is provided, which is able to move in the double arrow direction 19 relative to the applicator tube 3*a*. For this purpose, the grip end of the push rod 18 is connected to a rotary mechanism 20. The rotary mechanism 20 has a rotating cap 21 in the region of the grip 2. The rotating cap 21 is connected to a housing sleeve 22 in which a grip end region of the applicator tube is supported so that it is able to slide in the double arrow direction 19. The grip end region of the push rod 18 has a projection 23 that protrudes through a slot (not shown) of the sleeve 22 and travels in an inner helical groove 24 of a helical groove sleeve 25 that is affixed to the grip piece 2. By rotating the rotating cap 21 in the double arrow direction 26, it is thus possible to move the push rod 18 relative to the applicator tube 3*a*, in a linear fashion along the double arrow direction 19. The end of the push rod 18 oriented away from the grip piece 2 supports a second applicator region 8, which in this case as well, is embodied in the form of a brush applicator. The brush applicator is inserted into the end of the push rod 18 and by means of the rotary mechanism 20, can be moved either into an extended position according to FIG. 3 or a completely retracted position according to FIG. 3*a*.

In this embodiment, it is therefore advantageously possible for the second applicator region 8, which in this case is embodied in the form of a bristle applicator, to be positioned entirely inside the first applicator region 5 so that the presence of an interfering contour caused by the second applicator region 8 can be completely avoided by means of a linear sliding motion. In this embodiment as well, the second applicator region 8 can preferably be replaceably inserted into the push rod 18. The push rod 18 and the housing sleeve 22 are preferably fitted into one another (as a rule through appropriate dimensioning) so that over the intended service life (at least 40 extensions and retractions, with one day of repose between individual uses and the applicator stored in a horizontal position) essentially no mascara—or as little of it as possible—penetrates into the gap between the push rod 18 and the housing sleeve 22 so that there is essentially no hindrance to the extension and retraction and/or no penetration of mascara into the region of the grip 2. It can also be advantageous here to provide the gap between the push rod 18 and the housing sleeve 22 with a sliding gap seal such as an O-ring or a lip seal. It is likewise advantageous, for example, to provide a stripping element, which removes excess mascara compound from the second applicator region 8 when the second applicator region 8 is extended and retracted and acts on it with a predefinable quantity of mascara fluid, independent of the fluid level in the storage receptacle.

In another embodiment of a cosmetic applicator 1 according to the invention shown in FIGS. 4 and 4*a*, the operating principle of the cosmetic applicator 1 according to FIGS. 3 and 3*a* is fully realized so that a repeat description of the defining characteristics described in connection with FIGS. 3 and 3*a* is unnecessary at this point because the previous descriptions basically apply here, provided that nothing clearly contrary thereto arises from the differences disclosed for this exemplary embodiment. The embodiment according to FIGS. 4 and 4*a* differs from the embodiment according to FIGS. 3 and 3*a* merely in that the second applicator region, in addition to its ability to slide into the double arrow direction 19, is able to pivot around an axle 27 (double arrow direction 28). Also in this embodiment, the push rod 18 is able to rotate relative to the applicator tube 3*a* around the longitudinal axis 100 of the applicator tube 3*a*.

Figures 4, 4A, 4B, 4C, 4D:
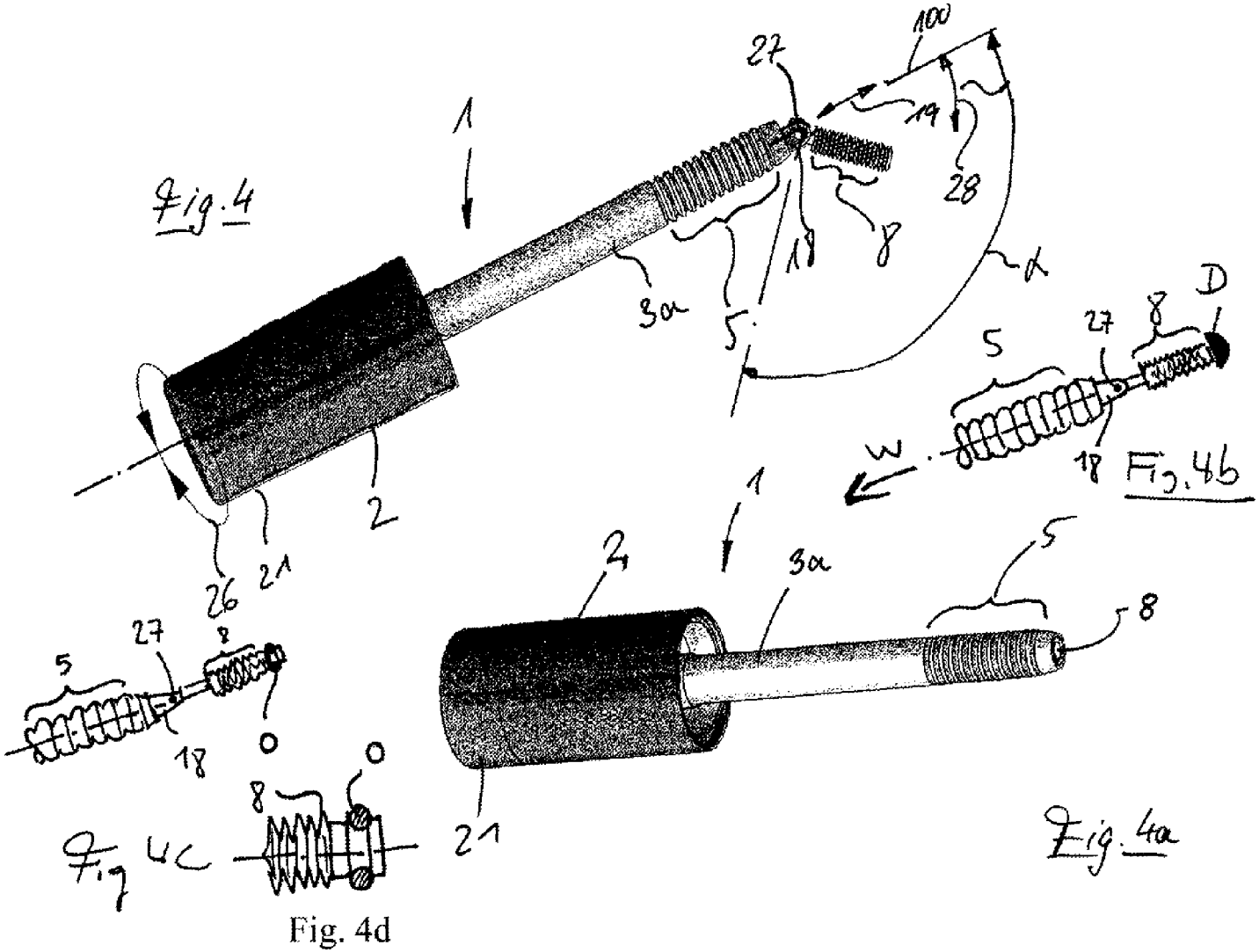
FIG. 4 shows another embodiment of the cosmetic applicator according to the invention, with a second applicator region in a deployed-for-use position.
FIG. 4*a* shows the cosmetic applicator according to FIG. 4, with the second applicator region in a stowed position.
FIG. 4*b* shows an optional variant of the embodiment according to FIGS. 4 and 4*a*.
FIG. 4*c* shows another optional variant of the embodiment according to FIGS. 4 and 4*a*.
FIG. 4*d* shows a detailed view of the additional applicator region in FIG. 4*c*.

In the embodiment according to FIGS. 4 and 4*a*, the additional applicator region 8 is thus supported so that it is able to pivot in hinge fashion relative to the first applicator region 5 around the axle 27. The pivoting range relative to the longitudinal axis 100 along the double arrow direction is preferably 0° to 120°, in particular 0° to 90°. The two hinge elements that cooperate with the axle 27 hold the axle 27 and/or the section situated between them, which belongs to the additional applicator region 8, with a frictional engagement powerful enough that the additional applicator region 8 can be brought into a position desired by the user, where it remains essentially stationary for the duration of the cosmetic application, at least as long as the user so desires. It should be noted that in general, it is extremely advantageous if the applicator—as it is here—is embodied so that the one part of the articulation between the first and second applicator parts is embodied on a push rod 18 so that the other applicator region can be selectively folded out or completely retracted.

In the embodiment according to FIGS. 4 and 4*a*, it is particularly advantageous that the cosmetic applicator with a retracted second applicator region 8 can, for example, be inserted into a storage receptacle containing mascara fluid. As a result, only the applicator region 5 is wetted with mascara fluid. The second applicator region 8 remains unwetted or virtually unwetted. After the application of mascara fluid with the applicator region 5, a virtually unwetted applicator region 8 can be extended and used for a fine distribution of the mascara fluid onto the eyelashes, without applying additional mascara fluid. In this case, it is particularly advantageous that the user does not have to change applicators because both a wet applicator and a "dry" applicator are combined in one and the same cosmetic applicator 1.

Preferably, a sealing element is provided, which produces a seal preventing mascara from penetrating into the interior of the applicator tube 3*a* when the additional applicator region 8 is pulled/retracted into it. FIG. 4*b* illustrates one example of how such a sealing element might look. In this case, a sealing element D (e.g. in the form of a soft elastomer projection) is mounted onto the distal end of the second applicator region and the preferably thread-actuated push rod pulls this sealing element against the annular end surface of the applicator tube 3*a* so that it forms a sealing "cover." Alternatively, it would also be conceivable to provide the distal end with an O-ring, for example, which is pulled in a sealing fashion into the applicator tube 3*a*, see FIG. 4*c* and FIG. 4*d*.

Figures 5, 5A, 5B, 5C:
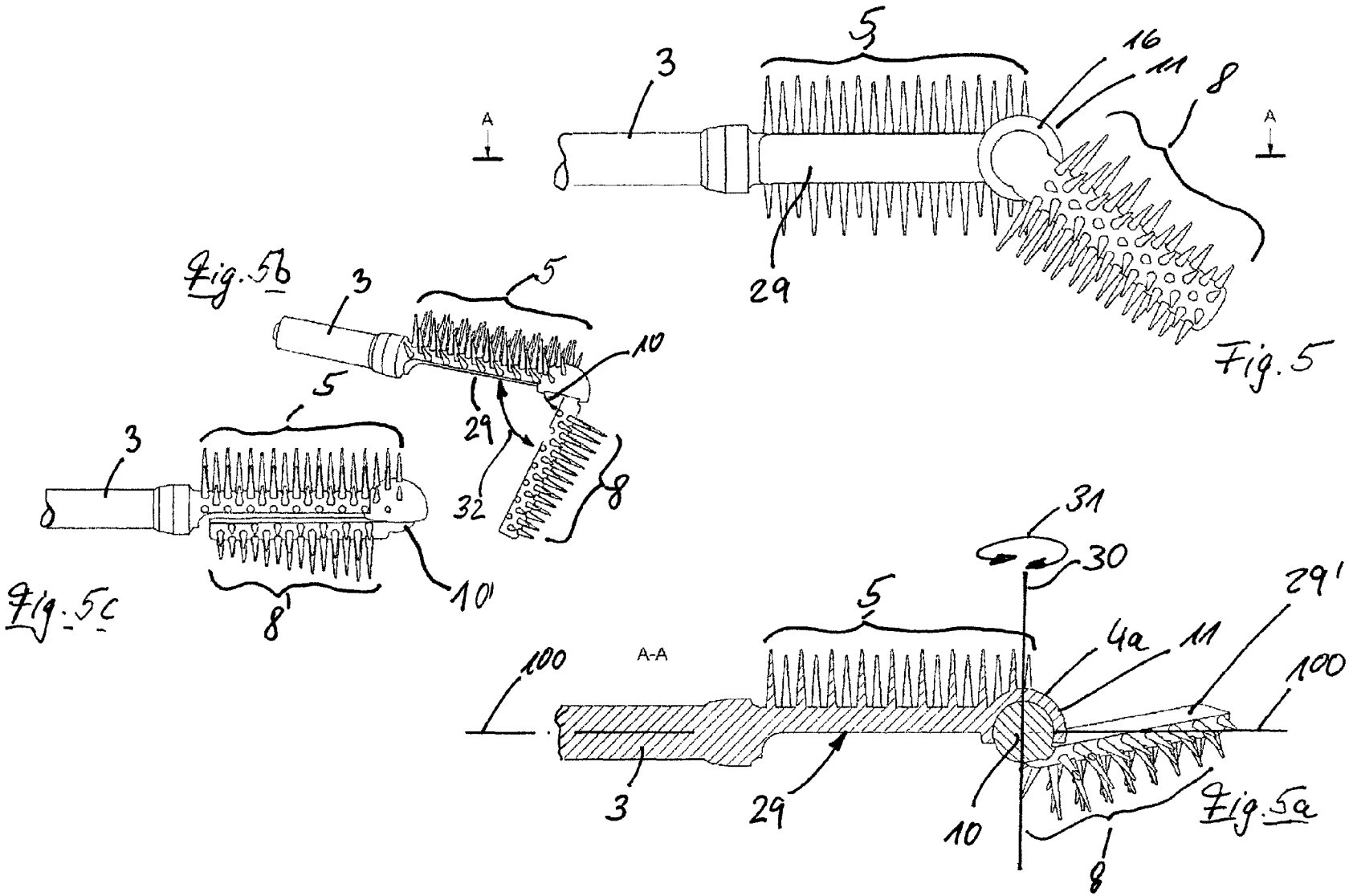
FIG. 5 is a top view of another embodiment of a cosmetic applicator according to the invention.
FIG. 5*a* shows a longitudinal section through the cosmetic applicator according to FIG. 5, along the cutting line A-A.
FIG. 5*b* shows the cosmetic applicator according to FIGS. 5 and 5*a* in a partially folded position of the applicator regions.
FIG. 5*c* shows the cosmetic applicator according to FIGS. 5 through 5*b* in a position in which the applicator regions are completely folded against each other.

In another embodiment of the cosmetic applicator 1 according to FIGS. 5 through 5*c*, the first applicator region 5 is embodied in the form of a semicircular brush applicator in which the applicator rod 3, in a region opposite from the bristles of the first applicator region 5, has a flattened area with a first contact plane 29. The first contact plane 29 is parallel to the longitudinal axis 100 and in a special embodiment, contains the longitudinal axis 100.

In lieu of such a flattened area, the applicator rod 3 can alternatively also have a pocket-like recess into which the additional, correspondingly slender/narrow-shaped applicator region can be folded in a fashion similar to the way in which the blade of a pocket knife is folded into its handle.

The joint socket 11 is situated at the distal end 4*a* of the first applicator region 5; the joint socket 11 is embodied as open in a direction transverse to the longitudinal axis 100. The second applicator region 8 has a second contact plane 29' that corresponds to the contact plane 29 and in the exemplary embodiment, is likewise embodied in the form of a semicircular brush applicator. The second applicator region 8 can be placed with its contact plane 29' against the contact plane 29 of the first applicator region 5 and has a joint ball 10 that is accommodated in the joint socket 11.

FIG. 5*c* shows the position in which the applicator regions 5, 8 are placed against each other. The two semicircular brush applicators 5, 8 consequently form one round brush applicator. From the position in which the two regions 5, 8 are placed against each other, the second applicator region 8 can be pivoted in a double arrow direction 31 around a transverse axis 30. Nevertheless, the second applicator region 8 can be swiveled out from the first applicator region 5 in a double arrow direction 32. Other degrees of freedom of movement ensue from the structural details of the ball-and-socket joint 10, 11.

The descriptions of the exemplary embodiments have referred to a first applicator region 5 and a second applicator region 8. Naturally, it is also possible to produce a cosmetic applicator 1 according to the invention that has more than two applicator regions.

It is naturally also possible to embody at least one applicator region 5 or 8 in the form of an elastically or plastically flexible applicator. By means of this, the brush applicator in the embodiment according to FIG. 3 or 4 can, for example, be brought from a straight orientation, as shown, into an intrinsically bent orientation.

In summary, it should be noted that even the sections of the applicator according to the invention that support bristles (and above all, the second, foldable applicator region 8), including the integral bristles, are manufactured if possible in the form of a one-piece injection-molded component or 2-component injection-molded component using a plastic that is sufficiently elastic to embody the bristles and is dimensionally stable enough to form a functional articulation component. If the 2-component injection-molding technique is used, then a harder plastic is used for the articulation component, through which a second, more elastic and/or softer plastic has been injected so as to form the bristles.

For the sake of completeness, various modifications and variations can be made to the disclosed structures without departing from the scope or spirit of the invention. For example, variations include a possibility of retracting/pulling an applicator region into the interior of the applicator tube 3*a* in such a way that the interior of the applicator tube 3*a* is thus completely sealed against (further) penetration of cosmetic so that the additional applicator region 8 is not wetted by the store of the cosmetic, but is instead stored in a "dry" or "essentially dry" state. Apart from this, it should also be noted that the applicators according to the invention are preferably mascara applicators that are typically characterized in that each individual applicator region has a length of ≤35 mm in the axial direction and perpendicular thereto, a maximum diameter of ≤12 mm, or better still, ≤8 mm.

The invention claimed is:

1. A cosmetic applicator, in particular a mascara applicator, comprising:

a first applicator region and at least one additional applicator region, wherein the first applicator region and the at least one additional applicator region are connected to each other in a way that allows the at least one additional applicator region to be slid in linear fashion relative to the first applicator region;

an applicator rod that is hollow and forms an applicator tube, wherein the applicator rod includes the first applicator region in the form of a grooved applicator;

a push rod that is positioned in the applicator tube and driven by a rotary mechanism to which a grip end region of the push rod is connected, wherein the rotary mechanism has a rotating cap in a region of a grip that is connected to a housing sleeve in which the grip end region of the push rod is supported so that the push rod is able to slide back and forth relative to the applicator tube; and the grip end region of the push rod has a projection that protrudes through a slot in the housing sleeve and travels in an inner helical groove of a helical groove sleeve that is affixed to the grip so that it is possible by rotating the rotating cap to move the push rod relative to the applicator tube, in a linear fashion, while an end of the push rod oriented away from the grip supports said additional applicator region which includes a brush applicator that is inserted into the end of the push rod and that can be moved by the rotary mechanism, either into an extended position in which a circumference of the brush applicator is fully accessible or in a completely retracted position in which bristles forming the circumference of the brush applicator are covered by the applicator tube.

2. The cosmetic applicator as recited in claim 1, wherein the first applicator region is situated closer to the grip of the applicator and the at least one additional applicator region is situated at a distal end of the first applicator region away from the grip of the applicator, at least when the at least one additional applicator region is in an operating position.

3. The cosmetic applicator as recited in claim 2, wherein it is possible to retract or extend the distally outer additional applicator region into or out of a cavity in the distally inner first applicator region.

4. The cosmetic applicator as recited in claim 1, wherein the at least one additional applicator region is embodied as replaceable.

5. The cosmetic applicator as recited in claim 1, wherein the first applicator region and the at least one additional applicator region are of different applicator types.

6. The cosmetic applicator as recited in claim 1, wherein the first applicator region is rigid relative to its longitudinal axis and the at least one additional applicator region is elastically flexible relative to its longitudinal axis.

7. A cosmetic product, in particular a mascara cosmetic product comprising a cosmetic applicator as recited in claim 1.

* * * * *

UNITED STATES PATENT AND TRADEMARK OFFICE

CERTIFICATE OF CORRECTION

PATENT NO. : 8,783,989 B2
APPLICATION NO. : 12/959259
DATED : July 22, 2014
INVENTOR(S) : Friedrich Weigel et al.

It is certified that error appears in the above-identified patent and that said Letters Patent is hereby corrected as shown below:

On the Title Page, Item "(30) Foreign Application Priority Data" should be inserted below Item (22).

--Foreign Application Priority Data
December 4, 2009 (DE) 102009057026.8--

Signed and Sealed this
Twentieth Day of January, 2015

Michelle K. Lee

Michelle K. Lee
*Deputy Director of the United States Patent and Trademark Office*